US010494162B1

(12) United States Patent
Jernigan et al.

(10) Patent No.: US 10,494,162 B1
(45) Date of Patent: Dec. 3, 2019

(54) MILK CRATE STABILIZER

(71) Applicant: Crate Mate Stabilizer Partners, Christiana, TN (US)

(72) Inventors: Matthew M. Jernigan, Christiana, TN (US); Jeffrey Marcum, Christiana, TN (US)

(73) Assignee: CRATE MATE STABILIZER PARTNERS, Christiana, TN (US)

( * ) Notice: Subject to any disclaimer, the term of this patent is extended or adjusted under 35 U.S.C. 154(b) by 0 days.

(21) Appl. No.: 16/130,577

(22) Filed: Sep. 13, 2018

(51) Int. Cl.

| | |
|---|---|
| ***B65D 71/70*** | (2006.01) |
| ***B65D 85/30*** | (2006.01) |
| ***B65D 71/00*** | (2006.01) |
| ***B65D 19/38*** | (2006.01) |

(52) U.S. Cl.
CPC ..... *B65D 71/70* (2013.01); *B65D 19/38* (2013.01); *B65D 71/0088* (2013.01); *B65D 85/305* (2013.01); *B65D 2571/00067* (2013.01)

(58) Field of Classification Search
CPC .... B65D 19/38; B65D 21/00; B65D 21/0088; B65D 21/70; B65D 85/30; B65D 85/305; B65D 2571/00067; B65D 71/00; B65D 71/0088; B65D 71/70
USPC ..... 206/386, 431, 504–509, 511, 595–600
See application file for complete search history.

(56) References Cited

U.S. PATENT DOCUMENTS

| | | | | |
|---|---|---|---|---|
| 1,926,432 | A | 9/1933 | Butts et al. | |
| 2,828,062 | A | 3/1958 | Fellowes | |
| 2,944,695 | A | 7/1960 | Yusz | |
| 3,146,505 | A | 9/1964 | Hansen | |
| 3,384,229 | A | 5/1968 | Kaschyk et al. | |
| 3,480,178 | A | 11/1969 | Morgan | |
| 3,752,310 | A * | 8/1973 | Higgin | B65D 71/0096 206/427 |
| 3,944,073 | A | 3/1976 | Downing | |
| 4,115,839 | A * | 9/1978 | Hummel | H02B 15/04 361/729 |
| 4,286,713 | A | 9/1981 | Marchais | |
| 4,787,553 | A | 11/1988 | Hoskins | |
| 5,145,060 | A | 9/1992 | Maye | |
| 6,389,989 | B1 * | 5/2002 | Hagerty | B65D 19/0036 108/57.25 |
| 8,235,214 | B2 * | 8/2012 | Eiten | B65D 19/0036 206/499 |
| 10,322,838 | B2 * | 6/2019 | Clark | B65D 21/04 |

FOREIGN PATENT DOCUMENTS

| | | | |
|---|---|---|---|
| CA | 2163675 | A1 | 5/1997 |

* cited by examiner

*Primary Examiner* — Bryon P Gehman
(74) *Attorney, Agent, or Firm* — Shane Cortesi

(57) ABSTRACT

A milk crate stabilizer system is described. The stabilizer system may include at least one row of milk crates, each milk crate comprising a floor, four sidewalls extending from the floor and defining an interior, and an open top, and a milk crate stabilizer comprising a plate located above the at least one row of milk crates, and a plurality of groups of four pegs extending downwardly from the plate. The pegs may contact the sidewalls of adjacent milk crates and removably join the adjacent milk crates. The bottoms of the pegs may be narrower than the tops of the pegs to facilitate placement into the corners of the milk crates.

20 Claims, 6 Drawing Sheets

MILK CRATE STABILIZER

BACKGROUND

Technical Field

The present invention relates to stabilizers for milk crates, especially milk crates stacked on pallets.

Background of the Invention

Milk crates are generally cubical containers with a floor, four sidewalls extending from the floor and defining an interior, and an open top. Traditionally, milk crates are comprised of rigid plastic and stacked on pallets in a 3 by 3 matrix (3 high by 3 across), with nine total milk crates in each row on the pallet. Such crates, however, are prone to tipping.

Canadian Patent Application No. 2,163,675 (the '675 Application) teaches a device with pegs that attaches to the rim of a crate. The crates are shown in the '675 Application, as single stacked, and the device is meant to be used on the bottom crate. The device of the '675 Application is not designed to prevent the top-most crates from tipping.

U.S. Pat. No. 3,146,505 (the '505 Patent) teaches a stacklip that extends into and attaches the corners of four adjacent cartons. The stacklips of the '505 Patent are not attached and thus the device would be cumbersome to use. The cartons of the '505 Patent are cardboard and the stacklips of the '505 Patent have specially designed ledges (denoted therein by numeral 96) that bite into the cardboard. The lower end of the legs (denoted by 56) are splayed outwardly at 58. It appears that the system of the '505 Patent would be cumbersome to use and is not designed for use with rigid plastic milk crates.

Therefore, there is a need for stabilizers that are designed for use with milk crates stacked on pallets that prevent the crates for tipping.

BRIEF SUMMARY

The present disclosure provides milk crate stabilizers as described herein.

In some embodiments, the system includes a) at least one (preferably a plurality of) row(s) of milk crates, each milk crate comprising a floor, four sidewalls extending from the floor and defining an interior, and an open top; and b) a milk crate stabilizer comprising a plate located above the at least one row of milk crates, and a plurality of groups of four pegs extending downwardly from the plate. Optionally, the pegs contact the sidewalls of adjacent milk crates and removably join the adjacent milk crates. Optionally, each peg comprises a top end extending from the plate, a free bottom end, a height extending from the top end to the bottom end, and a width generally perpendicular to the height and further wherein the peg width is less at the bottom end of the peg compared to the top end. Optionally, the plate is generally rectangular in shape and comprises a plate width and a plate length perpendicular to the plate width, the plate width and plate length perpendicular to the peg height. Optionally, two pegs in each group are aligned along the plate width and two pegs in each group are aligned along the plate length. Optionally, for each group, adjacent pegs are spaced approximately the same distance apart. Optionally, the plate comprises aperture handles located on opposite sides of the plate, the aperture handles extending through the plate. Optionally, the aperture handles are generally rectangular in shape. Optionally, the milk crate stabilizer further comprises a lower extender peg comprising a hollow interior, the lower extender peg removably attached to, and extending below, a peg. Optionally, each row comprises a plurality of adjacent milk crates, the adjacent milk crates having adjacent corners located in the respective crate interiors, and further wherein, in each group, at least two pegs are located in the adjacent corners of adjacent crates. Optionally, the milk crates are located on a pallet. Optionally, the pegs are rigid. Optionally, the system comprises a plurality of rows of milk crates and the plate is above the top row of milk crates. Optionally, pegs in each group are arranged in a rectangular pattern. Optionally, for each group, adjacent pegs are spaced about 1.25 inches apart. Optionally, the milk crates are comprised of rigid plastic.

BRIEF DESCRIPTION OF THE DRAWINGS

in FIG. 2, a milk crate is removed to show a peg.

in FIG. 10, the plate has been partially removed to better show how the pegs fit into the corners of the crates.

DETAILED DESCRIPTION

Figure 1:
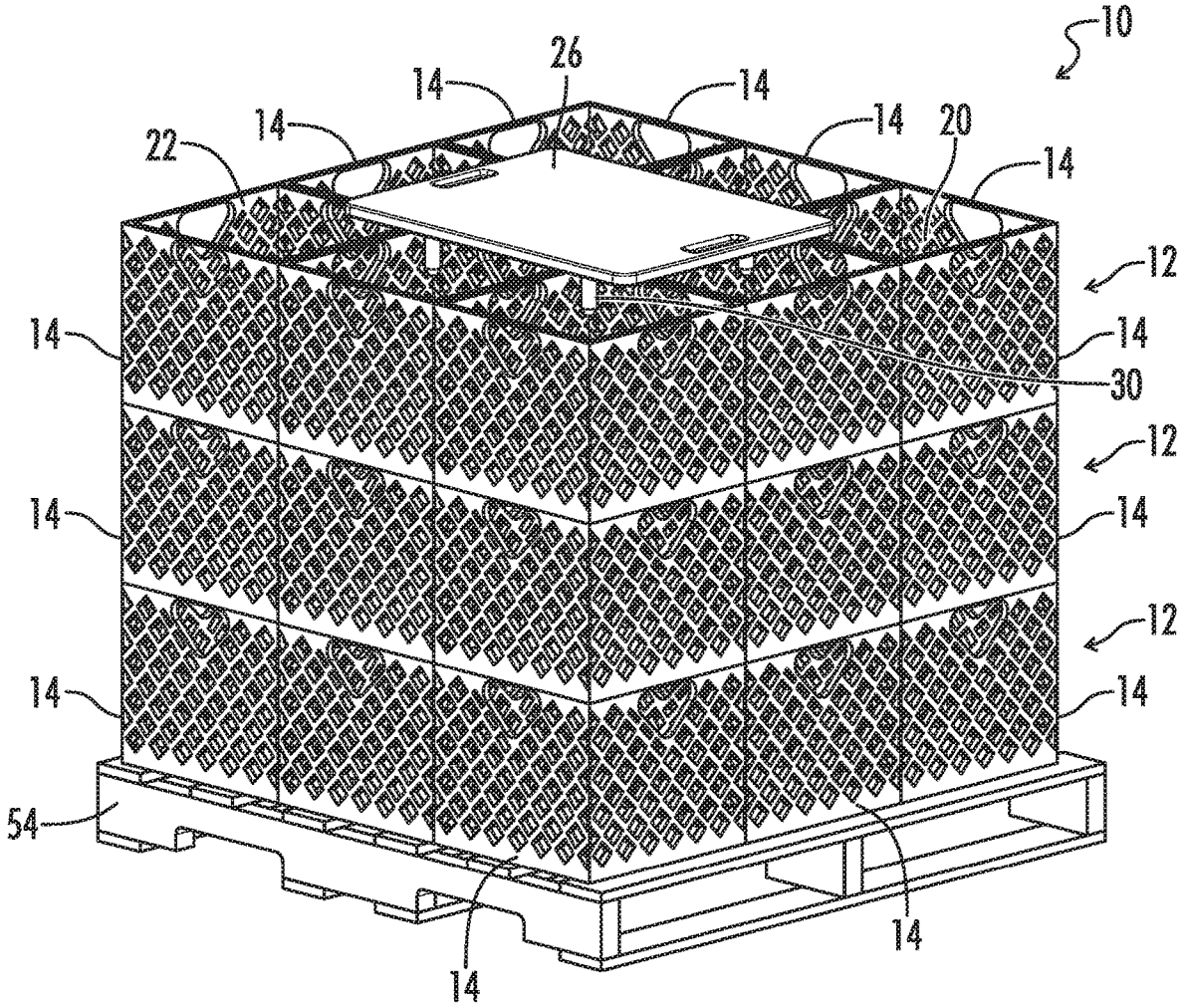
FIG. 1 illustrates a side perspective view of a milk crate stabilizer of one embodiment of the present invention that is located on top of a stack of milk crates, which in turn are located on a pallet.

With reference to FIGS. 1-10 the present invention provides a milk crate stabilizer system, designated by the numeral 10. In the drawings, not all reference numbers are included in each drawing for the sake of clarity. In addition, although other dimensions are possible, FIGS. 1-10 are CAD drawings, drawn to scale.

Figure 2:
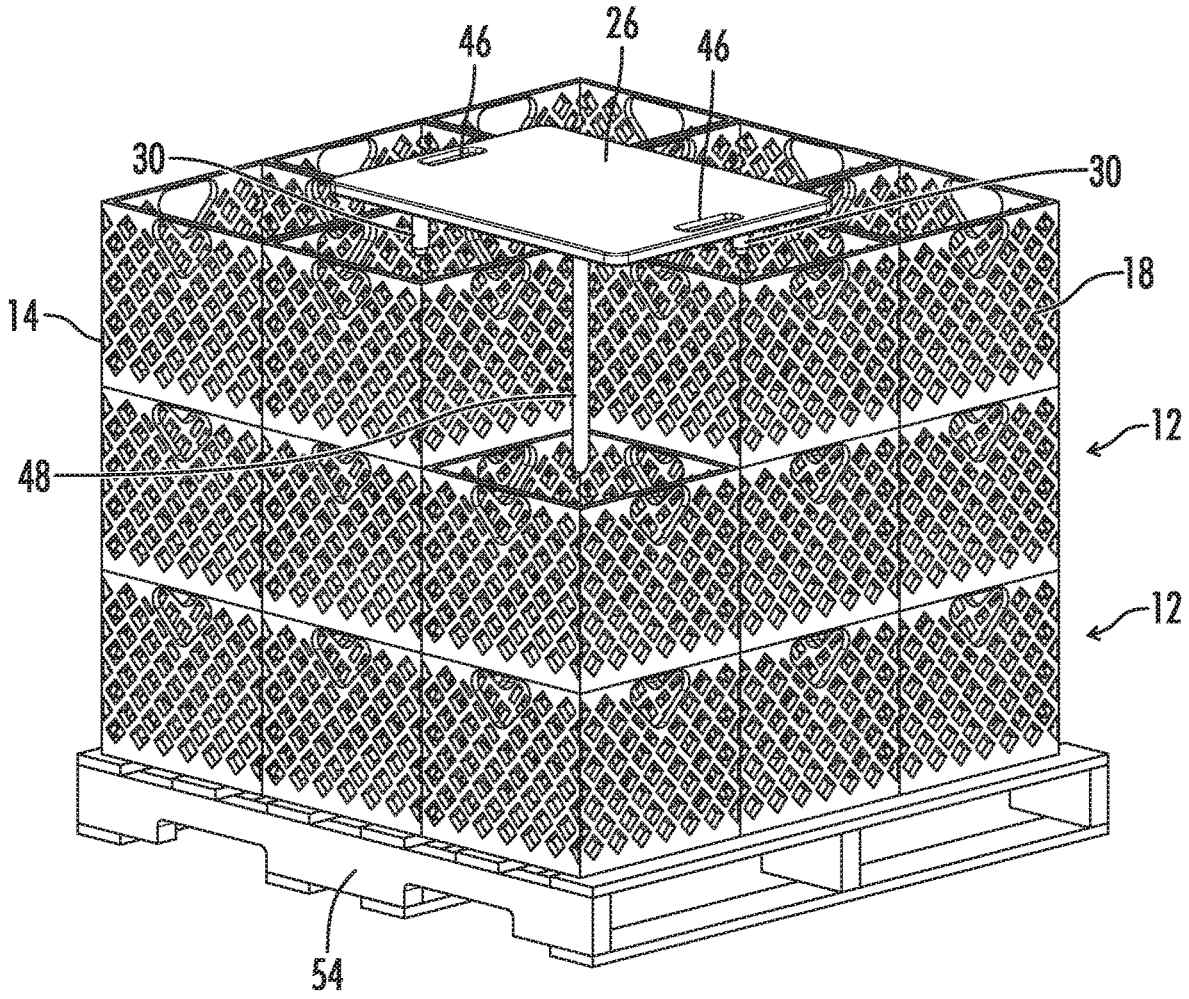
FIG. 2 illustrates a side perspective view of the milk crate stabilizer, stack of milk crates and pallet of FIG. 1 with a lower extender peg added to a peg.
Figure 3:
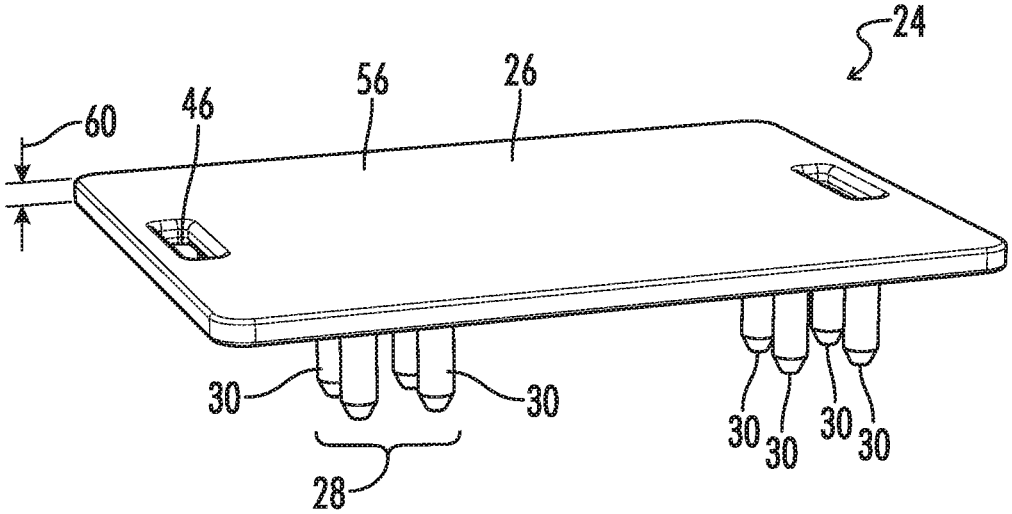
FIG. 3 illustrates a side perspective view of the milk crate stabilizer of FIG. 1.
Figure 4:
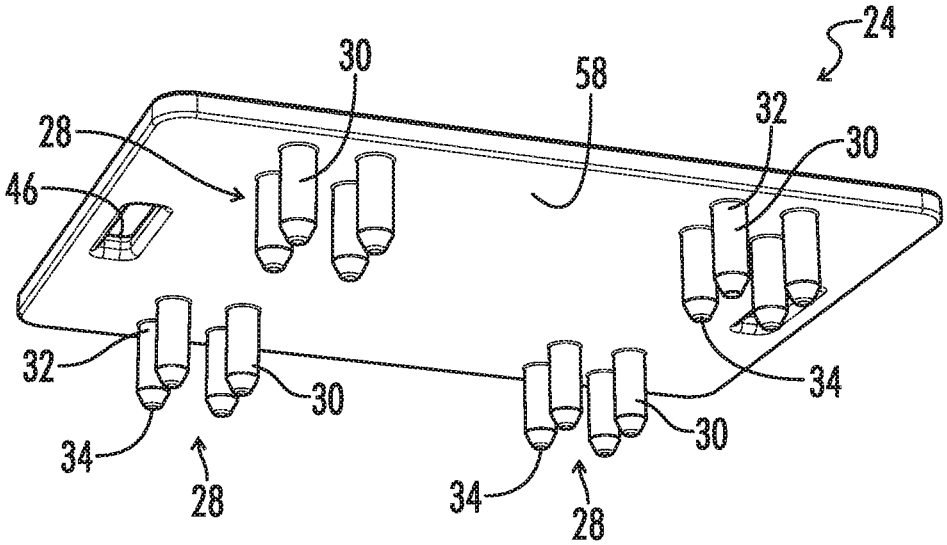
FIG. 4 illustrates a bottom perspective view of the milk crate stabilizer of FIG. 1.
Figure 10:
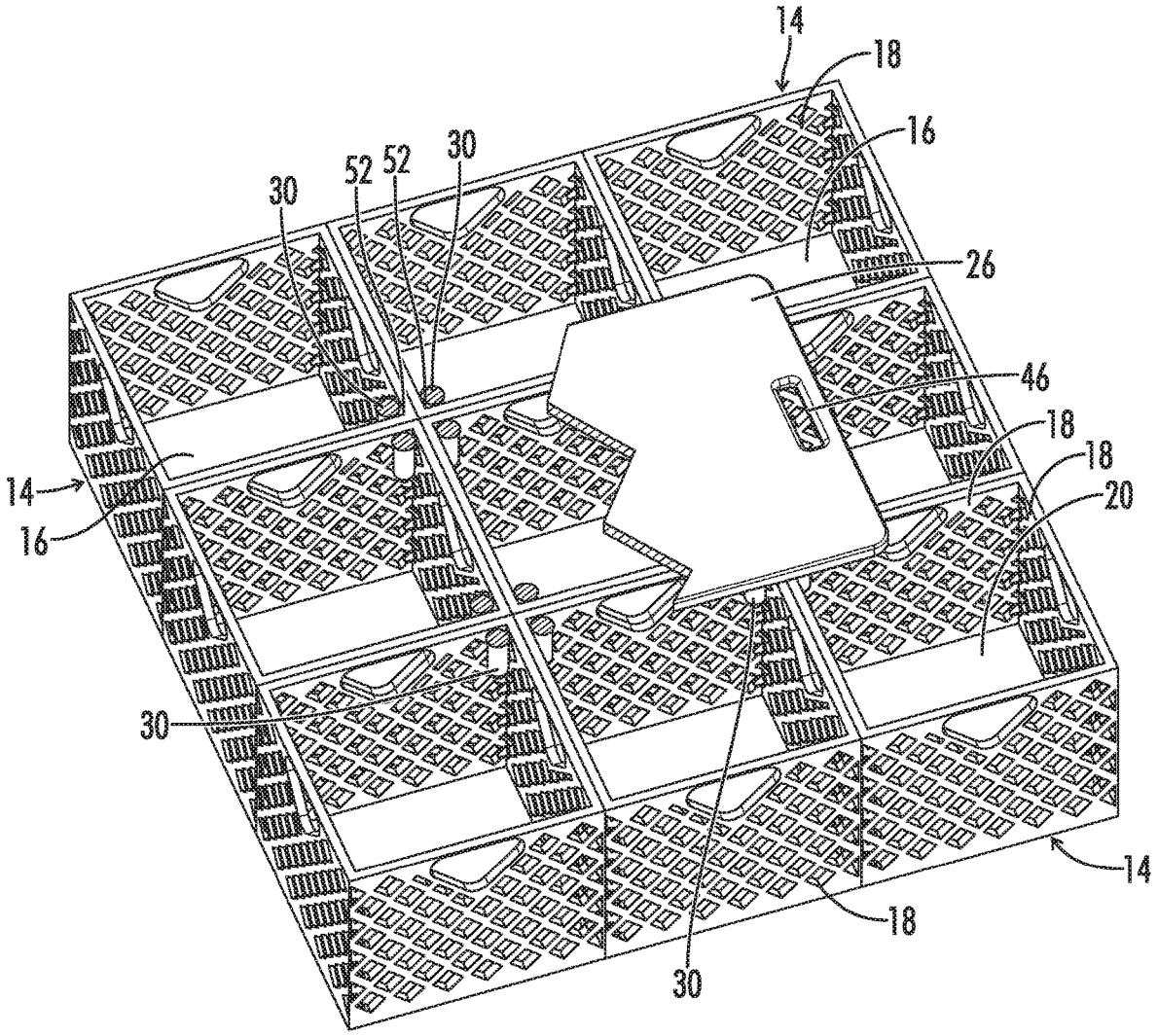
FIG. 10 illustrates a top perspective view of the milk crate stabilizer and the top row of milk crates of FIG. 1.

Referring to FIGS. 1-10, the milk crate stabilizer system 10 may include at least one row 12 of milk crates 14, each milk crate 14 comprising a floor 16, four sidewalls 18 extending from the floor 16 and defining an interior 20, and an open top 22. The milk crates 14 are preferably stacked on a pallet 54. The milk crates 14 are preferably comprised of a rigid plastic and cubical in shape. The floors 16 and sidewalls 18 may include holes in a lattice-type pattern, as depicted in FIGS. 1, 2 and 10, for example. Milk crates such as these are commonly known. In each vertical stack, the milk crates 14 are preferably partially nested inside each other.

The present disclosure provides a milk crate stabilizer 24 for use with such milk crates 14, particularly those stacked on a pallet 54 in columns of nine milk crates 14 per row 12, as depicted in FIGS. 1 and 2, for example. The milk crate stabilizer 24 may include a plate 26 located above the at least one row 12 of milk crates 14, and a plurality of groups 28 (preferably four groups) of four pegs 30 extending downwardly from the plate 26, and the pegs 30 contact the sidewalls 18 of adjacent milk crates 14 and removably join the adjacent milk crates 14, as best seen in FIGS. 1, 2 and 10. The milk crate stabilizer 24 may be formed of any material but is preferably rigid and comprised of, for example, plastic or wood. Preferably, at least the pegs 30 are rigid.

Figure 5:
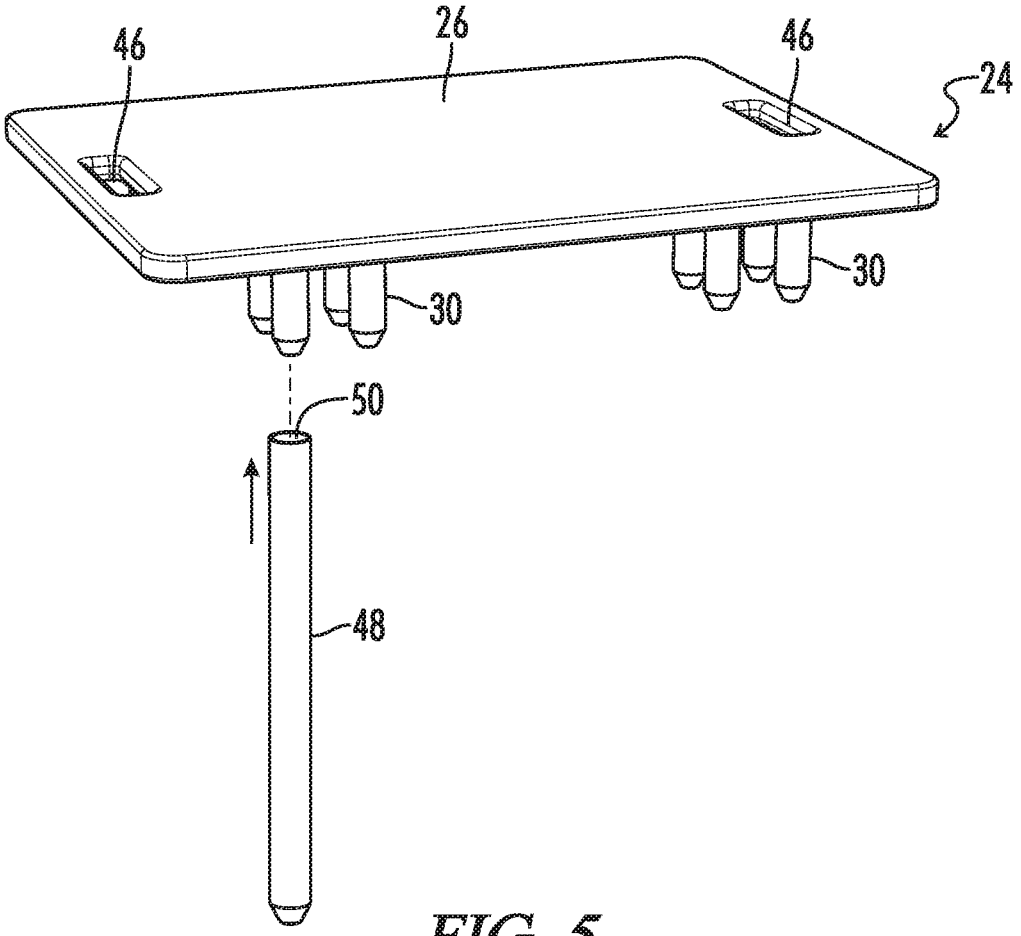
FIG. 5 illustrates an exploded bottom perspective view of the milk crate stabilizer of FIG. 1 with a lower extender peg being added to a peg.
Figure 6:
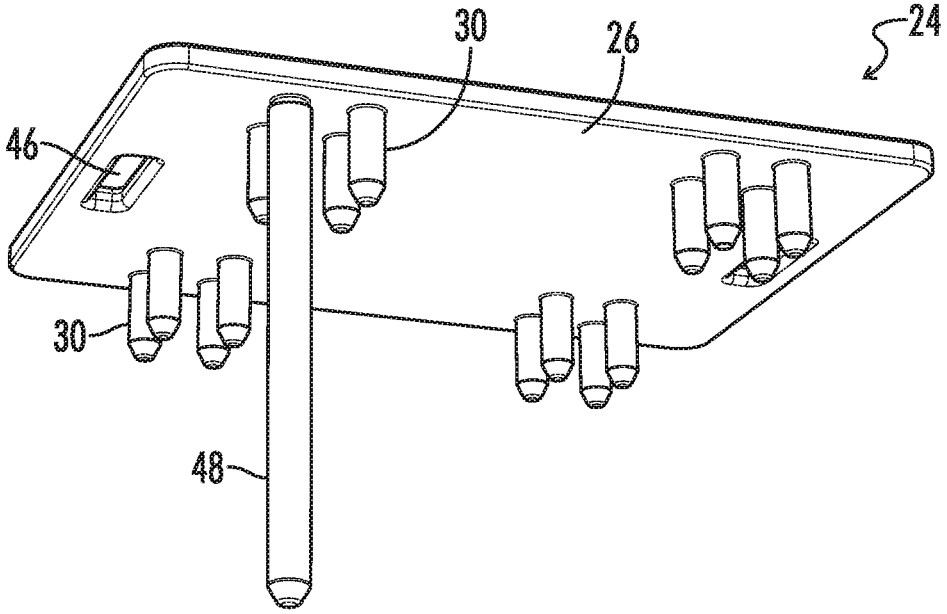
FIG. 6 illustrates an assembled bottom perspective view of the milk crate stabilizer of FIG. 5 with the lower extender peg added to the peg.
Figure 7:
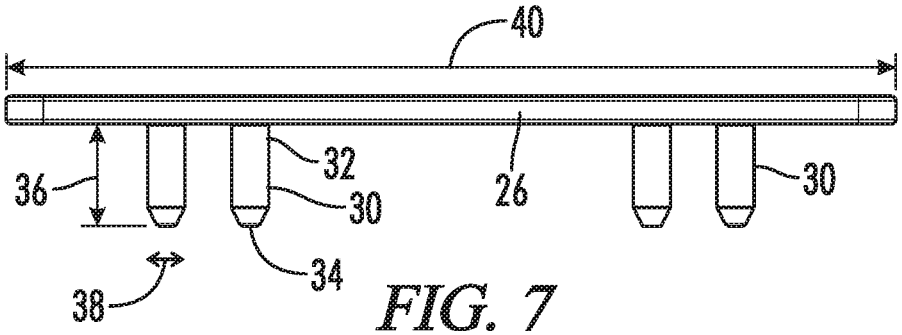
FIG. 7 illustrates a side elevation view of the milk crate stabilizer of FIG. 1.
Figure 8:
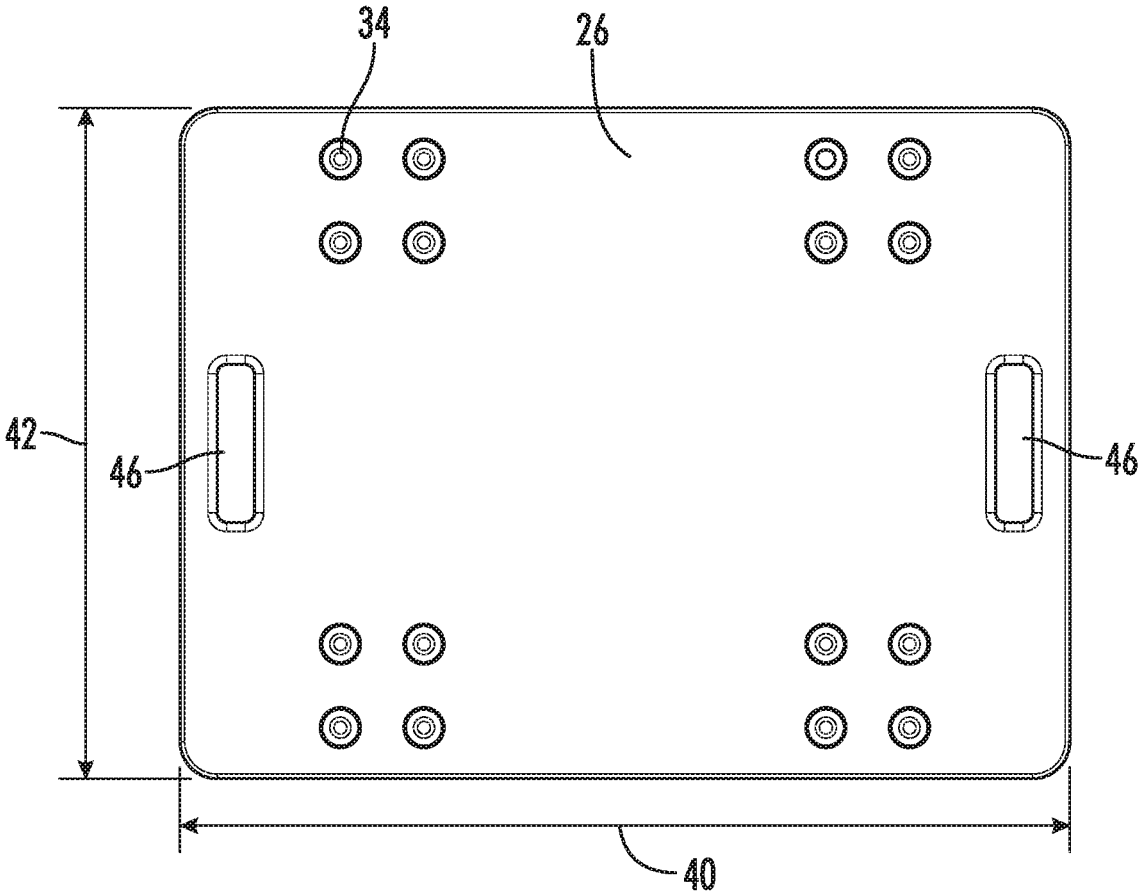
FIG. 8 illustrates a bottom plan view of the milk crate stabilizer of FIG. 1.
Figure 9:
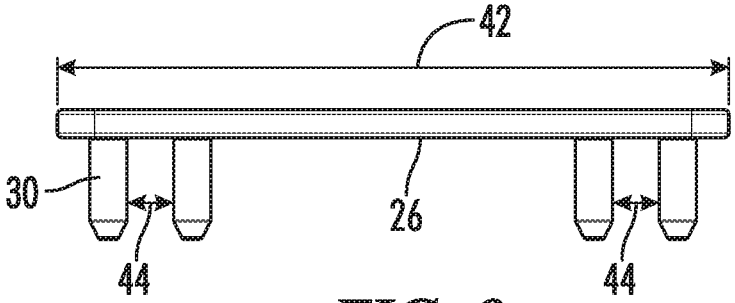
FIG. 9 illustrates another side elevation view of the milk crate stabilizer of FIG. 1.

In some embodiments, each peg 30 comprises a top end 32 extending from the plate 26, a free bottom end 34, a height 36 extending from the top end 32 to the bottom end 34, and a width 38 generally perpendicular to the height 36 and the peg width 38 is less at the bottom end 34 of the peg 30 compared to the top end 32. In other words, preferably, the pegs 30 are tapered as best seen in FIGS. 3-7 and 9. Optionally, the pegs 30 are tapered cylinders, as best seen in FIGS. 3-10. Optionally, the peg heights 36 of the pegs 30 are identical and are, for example, about 2.75 inches. Optionally, the plate 26 is generally rectangular in shape and comprises a plate width 40 and a plate length 42 perpendicular to the plate width 40. Optionally, two pegs 30 in each group 28 are aligned along the plate width 40 and two pegs 30 in each group 28 are aligned along the plate length 42, as best seen in FIGS. 6 and 8. Preferably, the pegs 30 in each group 28 are arranged in a rectangular pattern, as best seen in FIGS. 6 and 8. The plate 26 includes a top surface 56, a bottom surface 58 opposite the top surface 56 and facing the top-most row 12 of milk crates 14 and has a thickness 60 extending from the top surface 56 to the bottom surface 58. Preferably, the plate bottom surface 58 is flat. The peg bottom end 34 is located below the plate bottom surface 58.

Optionally, for each group 28, adjacent pegs 30 are spaced approximately the same distance apart. Optionally, all adjacent pegs 30 are spaced approximately the same distance apart as shown in FIG. 8. Optionally, for each group 28, adjacent pegs 30 are spaced between about 1.25 inches apart. Optionally, the plate 26 comprises aperture handles 46 located on opposite sides of the plate 26. The aperture handles 46 preferably extend through the entire thickness 60 of the plate 26, as best seen in FIGS. 3-6, 8, 10. The aperture handles 46 may be any suitable shape including generally rectangular.

Optionally, as best seen in FIG. 10, each row 12 comprises a plurality of adjacent milk crates 14, the adjacent milk crates 14 having adjacent corners 52 located in the respective crate interiors 20, and, in each group 28, at least two pegs 30 are located in the adjacent corners 52 of adjacent crates 14. For example, as shown in FIG. 10, each of the four pegs 30 in the group 28 are located in adjacent corners 52 of adjacent crates 14.

Preferably, the system comprises a plurality of rows 12 of milk crates 14 and the plate 26 is above the top row 12 of milk crates 14, as best seen in FIGS. 1, 2 and 10.

The pegs 30 may be any suitable height 36. In some embodiments, when the top-most row 12 of milk crates 14 contains a missing crate (e.g., eight crates instead of nine), it may be desirable to include a lower extender peg 48 comprising a hollow interior 50, the lower extender peg 48 removably attached to, and extending below, a peg 30 so that the lower extender peg 48 extends into the crate 14 in the row 12 below the top-most row 12, as shown in FIGS. 5 and 6. The lower extender peg 48 preferably also has a tapered bottom end.

The milk crate stabilizer 24 described herein may be used in any desired use but is preferably used in conjunction with milk crates 14 to prevent them from tipping on a pallet 54.

| Part List | |
|---|---|
| Milk crate stabilizer system | 10 |
| Row | 12 |
| Milk crates | 14 |
| Floor | 16 |
| Sidewall | 18 |
| Interior | 20 |
| Open top | 22 |
| Milk crate stabilizer | 24 |
| Plate | 26 |
| Group | 28 |
| Pegs | 30 |
| Peg top end | 32 |
| Peg bottom end | 34 |
| Peg height | 36 |
| Peg width | 38 |
| Plate width | 40 |
| Plate length | 42 |
| Distance between pegs | 44 |
| Aperture handles | 46 |
| Lower extender peg | 48 |
| Lower extender peg interior | 50 |
| Corners | 52 |
| Pallet | 54 |
| Plate top surface | 56 |
| Plate bottom surface | 58 |
| Plate thickness | 60 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies. In addition, the steps of the methods described herein can be performed in any suitable order, including simultaneously. It is understood that use of the singular embraces the plural and vice versa.

What is claimed is:

1. A milk crate stabilizer system comprising:

a) at least one row of milk crates, each milk crate comprising a floor, four sidewalls extending from the floor and defining an interior, and an open top; and b) a milk crate stabilizer comprising a plate located above the at least one row of milk crates, and a plurality of groups of four pegs extending downwardly from the plate, wherein the pegs contact the sidewalls of adjacent milk crates and removably join the adjacent milk crates, and further wherein the plate comprises aperture handles located on opposite sides of the plate.

2. The milk crate stabilizer system of claim 1 wherein each peg comprises a top end extending from the plate, a free bottom end, a height extending from the top end to the bottom end, and a width generally perpendicular to the height and further wherein the peg width is less at the bottom end of the peg compared to the top end.

3. The milk crate stabilizer system of claim 1 wherein the plate is generally rectangular in shape and comprises a plate width and a plate length perpendicular to the plate width.

4. The milk crate stabilizer system of claim 3 wherein two pegs in each group are aligned along the plate width and two pegs in each group are aligned along the plate length.

5. The milk crate stabilizer system of claim 1 wherein, for each group, adjacent pegs are spaced approximately the same distance apart.

6. The milk crate stabilizer system of claim 1 wherein the aperture handles are generally rectangular in shape.

7. The milk crate stabilizer system of claim 1 further comprising a lower extender peg comprising a hollow interior, the lower extender peg removably attached to, and extending below, a peg.

8. The milk crate stabilizer system of claim 1 wherein each row comprises a plurality of adjacent milk crates, the adjacent milk crates having adjacent corners located in the respective crate interiors, and further wherein, in each group, at least two pegs are located in the adjacent corners of adjacent crates.

9. The milk crate stabilizer system of claim 1 wherein the milk crates are located on a pallet.

10. The milk crate stabilizer system of claim 1 wherein the pegs are rigid.

11. The milk crate stabilizer system of claim 1 wherein the system comprises a plurality of rows of milk crates and the plate is above the top row of milk crates.

12. The milk crate stabilizer system of claim 1 wherein pegs in each group are arranged in a rectangular pattern.

13. The milk crate stabilizer system of claim 1 wherein, for each group, adjacent pegs are spaced about 1.25 inches apart.

14. The milk crate stabilizer system of claim 1 wherein the milk crates are comprised of rigid plastic.

15. The milk crate stabilizer system of claim 1 wherein each peg is in the shape of a tapered cylinder and comprises a top end extending from the plate, a free bottom end, a height extending from the top end to the bottom end, and a diameter generally perpendicular to the height, wherein the peg diameter is less at the bottom end of the peg compared to the top end, and further wherein the pegs contact and rest against exterior surfaces of the sidewalls of adjacent milk crates.

16. The milk crate stabilizer system of claim 1 wherein the plate is generally rectangular in shape and comprises a plate width and a plate length perpendicular to the plate width and further wherein two pegs in each group are aligned along the plate width and two pegs in each group are aligned along the plate length.

17. A milk crate stabilizer system comprising:

a) at least one row of milk crates, each milk crate comprising a floor, four sidewalls extending from the floor and defining an interior, and an open top; and b) a milk crate stabilizer comprising a plate located above the at least one row of milk crates, and a plurality of groups of four pegs extending downwardly from the plate, wherein the pegs contact the sidewalls of adjacent milk crates and removably join the adjacent milk crates, and further wherein the milk crate stabilizer further comprises a lower extender peg comprising a hollow interior, the lower extender peg removably attached to, and extending below, a peg.

18. The milk crate stabilizer system of claim 17 wherein each peg is in the shape of a tapered cylinder and comprises a top end extending from the plate, a free bottom end, a height extending from the top end to the bottom end, and a diameter generally perpendicular to the height, wherein the peg diameter is less at the bottom end of the peg compared to the top end, and further wherein the pegs contact and rest against exterior surfaces of the sidewalls of adjacent milk crates.

19. The milk crate stabilizer system of claim 17 wherein each peg comprises a top end extending from the plate, a free bottom end, a height extending from the top end to the bottom end, and a width generally perpendicular to the height and further wherein the peg width is less at the bottom end of the peg compared to the top end.

20. A milk crate stabilizer system comprising:

a) at least one row of milk crates, each milk crate comprising a floor, four sidewalls extending from the floor and defining an interior, and an open top; and b) a milk crate stabilizer comprising a plate located above the at least one row of milk crates, and a plurality of groups of four pegs extending downwardly from the plate, wherein the pegs contact and rest against exterior surfaces of the sidewalls of adjacent milk crates and removably join the adjacent milk crates, wherein each peg is in the shape of a tapered cylinder and comprises a top end extending from the plate, a free bottom end, a height extending from the top end to the bottom end, and a diameter generally perpendicular to the height, and further wherein the peg diameter is less at the bottom end of the peg compared to the top end.

* * * * *